US005174549A

United States Patent [19]

Driver

[11] Patent Number: 5,174,549

[45] Date of Patent: Dec. 29, 1992

[54] LIGHT WEIGHT TREE JACK FOR HARVESTING FIREWOOD WITH CHAIN SAWS

[76] Inventor: Wilfred D. Driver, 357 East 28th Street, Hamilton, Ontario, Canada, L8V 3J7

[21] Appl. No.: 823,972

[22] Filed: Jan. 22, 1992

[51] Int. Cl.[5] ..... B66F 13/00

[52] U.S. Cl. ..... 254/264; 254/133 R

[58] Field of Search ..... 254/99, 133 R, 47, DIG. 1, 254/264, 389, 390; 269/46, 296; 414/23, 592

[56] References Cited

U.S. PATENT DOCUMENTS

| | | | |
|---|---|---|---|
| 181,251 | 8/1876 | Curtis . | |
| 1,134,581 | 4/1915 | Barret . | |
| 2,492,597 | 12/1949 | Schnadt | 254/264 |
| 2,707,615 | 5/1955 | Green | 254/133 R |
| 3,266,773 | 8/1966 | Cole | 254/133 R |
| 4,201,375 | 5/1980 | Pierce | 269/46 |
| 4,304,394 | 12/1981 | O'Hara et al. | 254/133 R |

*Primary Examiner*—Robert C. Watson
*Attorney, Agent, or Firm*—Laurence R. Brown

[57] ABSTRACT

A light weight treejack suitable for use in the woods at a tree felling site to harvest firewood, pulpwood, and the like, with a chain saw is easy to carry and set up by a single person. A bowed first legpiece is coupled at the top to a straight second legpiece comprising a hollow U-shaped pipe with an internally journalled threaded member rotatable with an upper manually operated handle to move a mating threaded rider up and down the pipe. The trees are supported by a chain about the trunk adjustable in height by the jack at a desired position along the trunk with attached branches on its tree-top side aiding the jack to support the tree trunk at a comfortable level for using a chain saw without the danger of turning.

6 Claims, 1 Drawing Sheet

LIGHT WEIGHT TREE JACK FOR HARVESTING FIREWOOD WITH CHAIN SAWS

TECHNICAL FIELD

This invention relates to tree jacks, and more particularly it relates to jacks used to support tree trunks at a comfortable level for harvesting firewood, pulpwood and the like with chain saws.

BACKGROUND ART

Timber jacks are well known in the industry for lifting heavy logs off the ground. However, these are generally for handling heavy timber on smooth ground and are not portable. They have many other unsolved problems, and are not suitable when it is desirable for a single person to use the jacks alone in either the woods or at a tree felling site such as in a city after a wind storm. Most jacks require one person to manipulate the tree trunk and another to position the jack. Thus suitable tree jacks permitting a single person to harvest firewood, pulpwood, and the like from felled trees are not available.

When using chain saws to cut up tree trunks, it is difficult to cut squared blocks perpendicular to the tree axis supported by those prior art jacks that hold the tree at an angle to the ground. Also, it is dangerous to use a chain saw under conditions where the saw is not fully manually controlled with the user in a comfortable posture working upon tree trunks subject to unwanted turning or movement. Furthermore, a tree trunk must be held to avoid chain saw cuts that bind the sawblade, and in a position above ground so that the blade does not hit the ground with danger of losing control or at least damaging or wearing the blades with abrasives.

Nor are prior art timber jacks for cutting heavy logs particularly adapted to use in the woods in a tree felling site without site clearance and ground preparation. They are too heavy to carry into the woods by a single person. They are critical in placement, many being constructed for use on level ground. It is critical to balance and use the jacks so that a lifted tree trunk cannot inadvertently twist, turn or fall off the jack. Also they are apt to take up so much operating room that they cannot be used in many sites in thick woods where underbrush prohibits cleared worksites. Desired mechanisms for lifting trees must be light in weight and yet operable without significant efforts in balancing, leveling, or attachment to tree trunks.

U.S. Pat. No. 181,251, to H. A. Curtis. Aug. 22, 1876, for example, provides a general purpose lifting jack which could not be used at uneven ground timber felling sites without site preparation for anchoring two legs and positioning a crossbar to avoid tilt. Also a long jack handle that extends horizontally from the jack restricts the use to conditions where the site about a felled tree is cleared. Furthermore, a single person at the jack handle could not also reach to manipulate a chain about a tree trunk for engaging the jack, balancing it in position and initiating the lift of a heavy tree trunk.

J. H. Barret in U.S. Pat. No. 1,134,581, Apr. 6, 1915 grasps a tree trunk with claws and rotates a screw in a critically balanced crossbar to lift it. This jack is very restrictive in the size of trunk handled, and requires the cross bar holding the screw to be parallel with the ground for lifting a tree trunk vertically, which is not feasible at tree felling sites without preparation of a firm support surface or leveling ground such as usually encountered at sites in the woods or brush.

It is therefore a general object of this invention to remove the foregoing deficiencies of the prior art.

A more specific object of the invention is to provide a tree jack that can be used by a single person more ideally suited for harvesting firewood, pulpwood, or the like, with a chain saw at a variety of tree felling sites including those in heavy woods or brush.

Other objects, features and advantages of the invention will be found throughout the following description, claims and drawings.

DISCLOSURE OF THE INVENTION

A lightweight tree jack ideal for use by a single person at a tree felling site for cutting up the trunk with a chain saw is provided by this invention. The jack is adapted for substantially instant use to span a tree trunk where felled, even when on unlevel and soft ground locations at tree felling sites in the woods or brush. It can handle a wide range of sizes including large heavy trees. It can be used by a single person to attach to the tree and operate the lifting mechanism without requiring substantial site clearance for operation. It can lift the tree trunk to a comfortable cutting height with branches supporting one end and preventing rolling or twisting thereby to avoid binding, fatigue and danger.

This is achieved by a simple two legged mechanism which is simply placed over the tree trunk at the lift position. It is manipulated by a rotatable screw shaft on one leg to move a rider attached to a tree grasping chain up and down. Parallel or nonparallel legs are disposed on opposite sides of the trees in different embodiments. Thus, for example in one embodiment an acute angle that approximates triangular by means of a bowed upper portion in one leg will give strength with light weight piping and the like. Also, the legs are pivoted to carry in folded position. Parallel legs used vertically give the advantage of not tilting and thus are suitable on slanted or slippery surfaces. In another embodiment, a lift screw is journalled within a straight leg U-shaped pipe and has an upper rotatable handle so that little site clearance or preparation is necessary even in heavy woods or brush to simply place the legs to span a tree trunk. The tree trunk may be supported by the jack at a desired trunk position with tree top branches trimmed to keep one trunk end of the trunk off the ground at a comfortable cutting height. Thus, the chain saw can be used without pinching or binding and the jack can be repositioned along the tree trunk whenever desired with little effort by a single person. Thus the tree trunk limbs keep the tree from turning so that the jack legs do not tend to sway or become dislodged. An embodiment with generally triangular leg configuration also tends to limit sway resulting from three piece, rectangular shaped arrays. The two-legged jacks provide more tolerance under conditions where the legs simply span the tree trunks and adapt to ground conditions at the felling site.

THE PREFERRED EMBODIMENT

Figure 1:
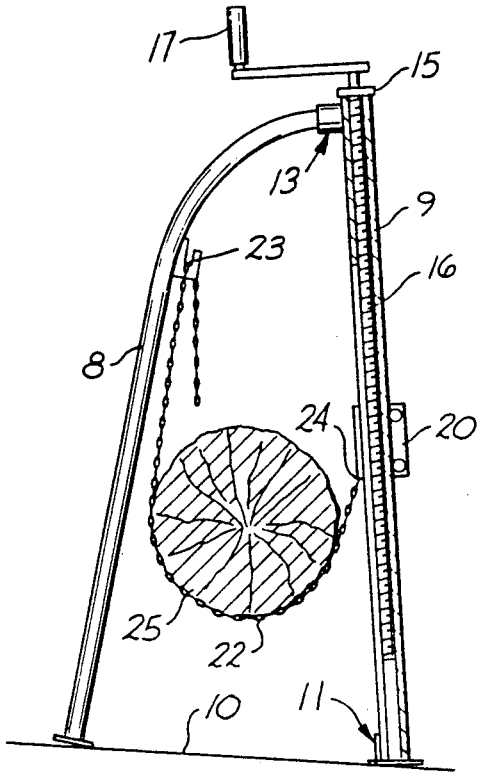
FIG. 1 is a broadside sketch, partly broken away, looking into the axis of a tree trunk, being lifted of a preferred lift embodiment afforded by this invention.

As best seen in FIG. 1, the jack mechanism has two legpieces 8,9 disposed with the legs slanted between ground 10 and pivoted joint 13 in a generally triangular acute angle configuration. The two-legged construction gives strength against sway and makes the device stable with the use of few parts. Also the slanted legs and triangular shape strengthens the lifting capacity of the jack. Support footplates 11 on the generally hollow pipes of the legs provide stable footing and is a requirement to limit penetration into soft ground such a found in-situ at felling sites in the woods or brush. The hollow pipes keeps down the weight without material sacrifice of strength.

The U-shaped pipe 9 with a slot for engaging rider nut 20 teeth with screw threads 16 journalled therein for rotation by means of bearings 15, for example. The threaded, rotatable lift screw assembly is coupled to rotate by means of handle 17. Thus, the rider nut 20 with mating threads moves up and down the leg 9 by manual rotation of the handle 17. The chain 22 is coupled at anchor hook 23 at the upper portion of the leg 8 and at anchor connection 24 to the rider 20 for encompassing a tree trunk 25 to lift it to support it at a suitable height for chain sawing. The pivot joint 13 permits the arms to fold for convenient carrying.

Figure 3:
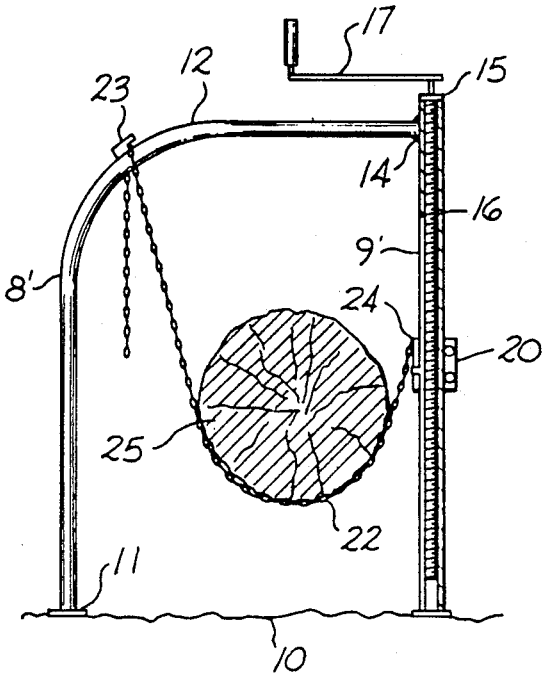
FIG. 3 is a broadside sketch of a further embodiment of the tree jack.

The FIG. 3 version with parallel legs 8', 9', and more rectangular shape with crossbar 12 has the advantage of a wider stance and better support on slanted, slippery ground because of the parallel legs 8', 9', separated by the bowed crossbar 12 are less apt to tilt. The welded or otherwise fixed firm joint 14 prevents folding of the legs.

Figure 2:
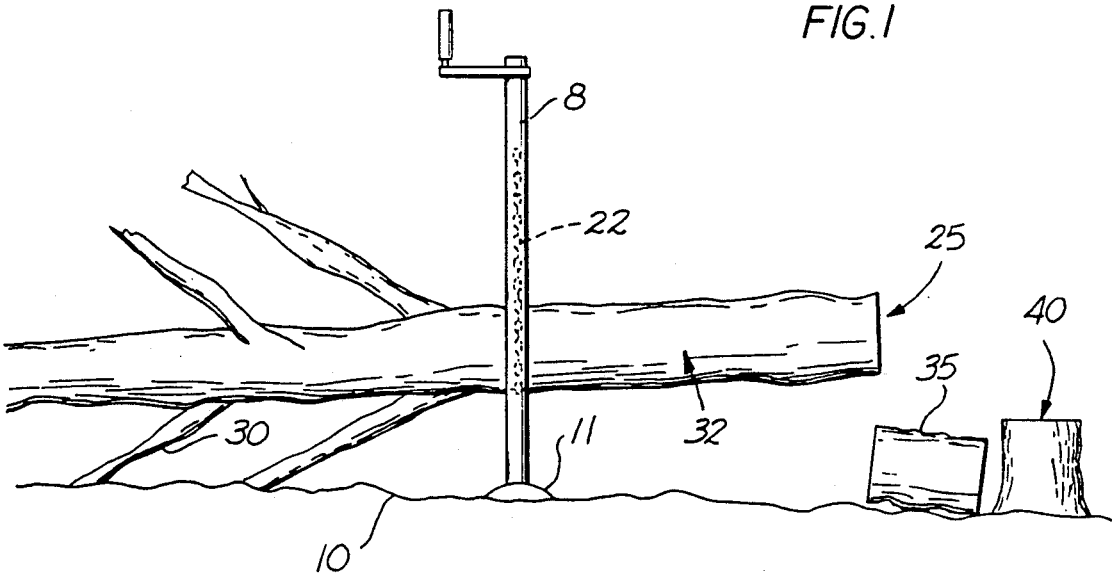
FIG. 2 is a side view sketch of a tree being harvested for firewood with the jack in use.

As seen in FIG. 2, the tree branches 30 support the tree trunk 32 so that the jack can be placed appropriately for holding the trunk off the ground and substantially horizontal on level ground so that the blocks 35 may be chain sawed off when firewood is harvested, for example. The jack takes up little room and is light to carry into the woods or brush, and can be placed and operated without substantial clearing of the site at the tree 40 being felled. Thus, a user straddles legs 8 and 9 over the tree trunk 25 without necessity for site clearance and handle 17 can be operated even in heavy woods or brush without clearing a site or making room for manipulation.

Accordingly this invention advances the state of the art an those novel features descriptive of the nature and spirit of the invention are defined with particularity in the following claims.

I claim:

1. A light weight tree jack for use at a felling site for harvesting firewood, pulpwood or the like, with a chain saw, comprising in combination, a substantially straight first legpiece shaped with a bowed crossmember at an upper end terminating into a coupling fitting firmly attached to a second legpiece, a ground support member at a lowermost end, and a line holding fitting near the upper end, a second substantially straight legpiece for mating near an upper end with said coupling fitting on the first legpiece and comprising a U-shaped pipe containing an internally journalled rotatable threaded member and having at a lowermost end of the second legpiece a ground support member, a line coupled to said line holding fitting, and jacking means comprising a rotatable handle for said threaded member located at the top of the pipe and a movable line holding rider for attachment to said line and for moving up and down the pipe with mating threads extending into the U-shaped pipe, said rider being coupled to threads on the threaded member to move in response to rotation of said handle from one side of the trunk whereby the line supports a tree trunk at selected distances off ground.

2. The tree jack of claim 1 further comprising: a felled tree having limbs retained thereon, with the line positioned along a tree trunk position at a felling site to hold the trunk at said selected distance off the ground while supporting the trunk off the ground by said limbs positioned on a treetop side of the jack to keep the tree trunk in a substantially horizontal position.

3. The tree jack of claim 1 further comprising a configuration wherein the legpieces are disposed in a generally triangular configuration when placed on the ground.

4. The tree jack of claim 1 wherein the coupling fitting comprises a pivot joint for folding the legs during transport.

5. The tree jack of claim 1 wherein the first legpiece has its bowed crossmember configured to maintain the two legs substantially parallel.

6. A portable light weight tree jack system for harvesting wood at a felling site with a chain saw, comprising in combination:

a bowed legpiece member attached to a straight legpiece member at an upper end position of the two legpiece members in an assembly adapted to straddle a felled tree trunk, a fixed line holding fitting near the upper end of the bowed legpiece and a movable line holding fitting for the straight legpiece, jacking means comprising a rotatable screw within the straight leg for moving said movable line holding fitting up and down the straight legpiece, a line coupled between the fittings adapted to nest a felled tree trunk between the line and the upper end of the two legpiece members, and a felled tree having limbs retained thereon with the line positioned under a tree trunk position at a felling site to hold the trunk at a distance off the ground maintaining the trunk substantially horizontal while supporting the trunk by said limbs on a treetop side of the line.

* * * * *